US005123123A

United States Patent [19]

Hart et al.

[11] Patent Number: 5,123,123

[45] Date of Patent: Jun. 23, 1992

[54] BATHTUB OVERFLOW CONTROL DEVICE

[75] Inventors: Thomas G. Hart, North Brunswick; Peter Hladik, Piscataway, both of N.J.

[73] Assignee: American Standard Inc., New York, N.Y.

[21] Appl. No.: 642,621

[22] Filed: Jan. 17, 1991

[51] Int. Cl.[5] ..... E03C 1/24

[52] U.S. Cl. ..... 4/684; 16/121; 4/694

[58] Field of Search ..... 4/198-204; 16/121, DIG. 24, DIG. 30; 411/377, 431

[56] References Cited

U.S. PATENT DOCUMENTS

| | | | |
|---|---|---|---|
| 1,901,118 | 3/1933 | Pope . | |
| 2,098,515 | 11/1937 | Pardieck | 403/354 |
| 2,477,478 | 7/1949 | Donahue | 4/198 X |
| 2,832,081 | 4/1958 | Young | 4/199 |
| 3,121,879 | 2/1964 | Young | 4/198 |
| 4,132,129 | 1/1979 | Pratt | 16/121 X |
| 4,548,590 | 10/1985 | Green | 446/120 |
| 4,594,738 | 6/1986 | Gebert | 4/198 X |
| 4,744,108 | 5/1988 | Schmidt . | |
| 4,779,305 | 10/1988 | Gorsek | 16/DIG. 30 X |
| 4,796,310 | 1/1989 | Freville et al. | 4/199 |
| 4,796,348 | 1/1989 | Rosen | 29/401.1 |
| 4,945,579 | 8/1990 | Husting | 4/199 X |

FOREIGN PATENT DOCUMENTS

| | | | |
|---|---|---|---|
| 2946073 | 5/1981 | Fed. Rep. of Germany . | |
| 3235970 | 3/1984 | Fed. Rep. of Germany . | |
| 8602370 | 4/1986 | Fed. Rep. of Germany . | |
| 3603877 | 9/1986 | Fed. Rep. of Germany . | |
| 0591293 | 7/1925 | France | 4/191 |
| 0744099 | 4/1933 | France | 4/199 |
| 2302392 | 9/1976 | France . | |

*Primary Examiner*—Charles E. Phillips
*Attorney, Agent, or Firm*—Blum Kaplan

[57] ABSTRACT

A control mechanism for use with a bathtub having a drain opening and an overflow opening, with the drain opening having a stopper moveable between open and closed positions. The control mechanism includes a pipe for coupling the bathtub drain opening to the overflow opening and a T-shaped bracket rotatably supported in the overflow opening having a projection extending outwardly from the opening and having first and second opposing legs extending radially therefrom. A handle is releasably supported on the T-shaped bracket for rotating the bracket. The handle includes a front decorative and an opposing rear surface which includes rearwardly extending tongues having flanges for releasably capturing the first and second opposing legs. A linkage mechanism couples the T-shaped bracket to the stopper to control movement of the stopper.

13 Claims, 3 Drawing Sheets

FIG. 3
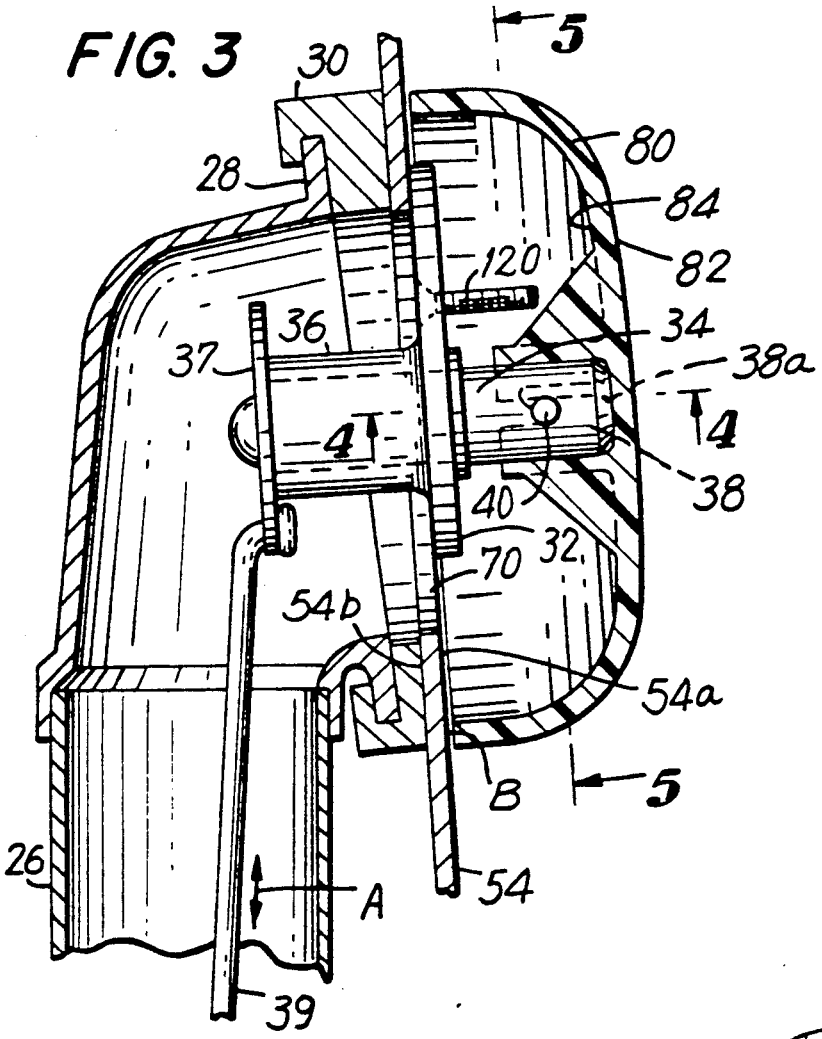
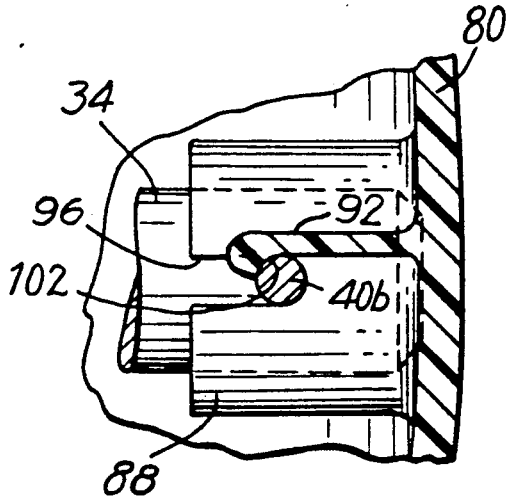
FIG. 6
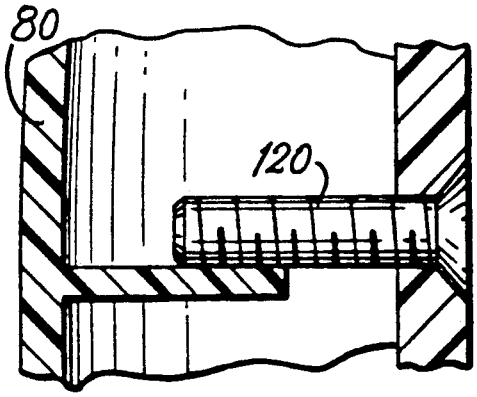
FIG. 7

BATHTUB OVERFLOW CONTROL DEVICE

BACKGROUND OF THE INVENTION

The present invention is directed to a bathtub overflow control device and, in particular, to a combined decorative handle and operative overflow control mechanism for use in tubs such as bathtubs, whirlpool tubs, sauna tubs and the like.

In conventional tubs, the drain opening is situated in the floor of the tub and usually includes a pop-up drain stopper to open and close the drain opening. That pop-up drain stopper is generally actuated by a pivotable handle situated on the wall of the tub at an overflow opening and coupled through an appropriate linkage mechanism to the pop-up stopper. The linkage mechanism is generally confined in a tube or pipe which couples the overflow opening in the sidewall of the tub to the drain opening in the tub and ultimately to the main drain. Hence, the overflow opening acts both to receive water above a certain height in the tub to prevent overflow thereof and as a means for anchoring the pivotable lever which controls action of the pop-up stopper in the drain. One form of such a conventional tub drain and overflow control mechanism is described in U.S. Pat. No. 4,796,310.

During installation of conventional tubs and their associated drain pipes and hardware, it has been found that the drain actuation mechanism, both internal and external, is sometimes damaged during installation. In addition, in this time of heightened design consciousness, it is desirable to provide a more ornamental handle in which shape and color can be readily selected to compliment the tub appearance and to permit ready replacement when necessary or appropriate.

U.S. Pat. No. 4,744,108 discloses a rotatable cover plate for the overflow opening which is held to the drain control linkage mechanism by a set screw which is different to access.

Accordingly, it is desired to provide an improved bathtub overflow control device in which both mechanical and design features are considered.

SUMMARY OF THE INVENTION

Generally speaking, in accordance with the present invention, a control mechanism for use with a tub having a drain opening and an overflow opening, is provided. The drain opening includes a stopper moveable between an open position and a closed position. The control mechanism includes a pipe for coupling the bathtub drain opening to the overflow opening and a T-shaped bracket rotatably supported in the overflow opening having a projection extending outwardly from the opening and having first and second opposing legs extending radially therefrom. A handle is releasably supported on the T-shaped bracket for rotating the bracket. The handle includes a front decorative surface and an opposing rear surface. The rear surface includes a recess therein adapted to receive a portion of the projection and rearwardly extending first and second tongues respectively in alignment with the first and second opposing legs. Each tongue includes a flange or undercut for releasably capturing the respective first and second opposing legs. The control mechanism further includes a linkage system for linking the T-shaped bracket to the moveable stopper.

In a preferred embodiment, the handle is molded from a plastic material and can be provided in various shapes, sizes and colors to coordinate with various tubs on which it will be used. The coupling device permits removal of a selected handle after insertion on the bracket to permit repair or replacement of the handle and mechanism. Since the handle is inserted after tub installation, damage to the handle is prevented during tub installation.

Accordingly, it is an object of the present invention to provide an improved bathtub overflow device.

Another object of the present invention is to provide a handle for a bathtub overflow device which is decorative in appearance and readily coupleable to an overflow control bracket.

A further object of the present invention is to provide an improved control mechanism for a bathtub overflow device utilizing a T-shaped rotatable bracket and a plastic decorative handle releasably supportable thereon.

A still further object of the present invention is to provide a bathtub overflow control system utilizing a decorative handle which is design coordinated with the bathtub on which it will be used and which is low in cost and easy to manufacture.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is an enlarged sectional view taken along line 3—3 of FIG. 1;

FIG. 6 is a sectional view taken along line 6—6 of FIG. 5; and,

FIG. 7 is a sectional view taken along line 7—7 of FIG. 5.

DETAILED DESCRIPTION OF THE PREFERRED EMBODIMENTS

Figure 1:
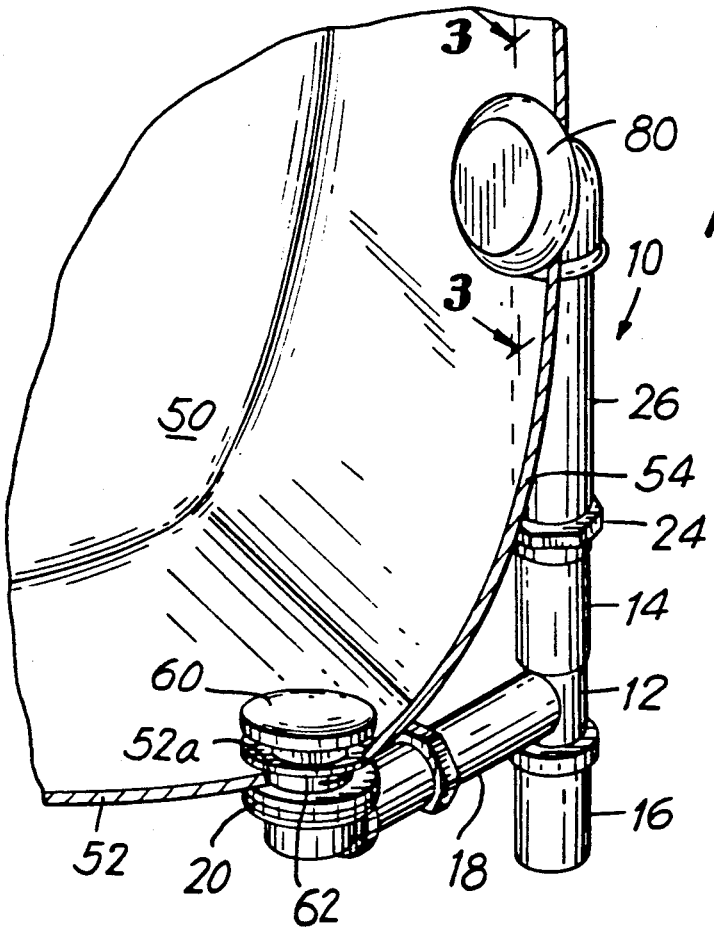
FIG. 1 is a perspective view of a bathtub overflow and drain control system constructed in accordance with the present invention shown in place on a portion of a tub.

Reference is made to FIGS. 1 through 7 of the drawings which depict a bathtub overflow control device, generally indicated at 10, constructed in accordance with the present invention. Control device 10 includes a T-shaped pipe 12 having an upwardly extending arm 14, a downwardly extending arm 16 coupleable to a drain pipe and an outwardly extending arm 18 coupleable to a pop-up drain assembly 20.

Control device 10 is adapted to be fitted to a tub enclosure 50 having a bottom wall 52 and a sidewall 54. Drain assembly 20 is coupled in a well known manner to an opening 52*a* in bottom wall 52 of tub 50. Drain assembly 20 includes a stopper 60 selectively displaceable between an upper open position where water in the tub can flow through a drain plug 62 into pipe 18 and down through pipe 16 into the main drain, and a lower position where water is prevented from flowing out of drain assembly 20.

Upwardly extending pipe arm 14 is coupled through an appropriate slip joint nut 24 to an overflow pipe 26 which terminates at its upper end in an enlarged head 28 over which an overflow gasket 30 is fitted as best depicted in FIG. 3.

Sidewall 54 of tub 50 includes an appropriately sized overflow opening 70. An overflow mounting plate 32 on front surface 54*a* of tub sidewall 54 secures enlarged head 28 through gasket 30 against rear surface 54*b* of sidewall 54. Appropriate screws may be used to secure the assembly.

Mounting plate 32 includes an enlarged lug 34 which is rotatably supported in mounting plate 32, and includes a rearwardly extending projection 36 and a forwardly extending projection 38. Rearwardly extending projection 36 terminates in an enlarged ring 37 which rotates therewith. A linkage rod 39 is coupled off center of disk 37 to provide a camming action sc that it can be moved in the reciprocal directions indicated by arrow A a lug 34 is rotated. Linkage rod 39 is coupled in a well known manner, such as in the manner disclosed in U.S. Pat. Nos. 4,796,310 and 4,744,108, the disclosures of which are incorporated by reference herein as though fully set forth, to actuate stopper 60 and cause stopper 60 to move intermediate its open and closed positions. Hence, rotation of lug 34 causes corresponding up and down movement of stopper 60.

Projection 38 of lug 34 is T-shaped and includes a pin 40 extending therethrough in a position set back from the front end 38*a* of projection 38. Pin 40 includes a first arm 40*a* and a second arm 40*b*. Together, lug 34 and pin 40 define a T-shaped bracket which is rotatably supported by mounting plate 32.

A handle 80, preferably molded from a plastic material, includes a front decorative surface 82 and a rear surface 84. Rear surface 84 includes a molded recessed portion 86 defined by a circular wall 88 and first and second tongues 90 and 92 proximate circular wall 88. Circular wall 88 includes opposing cutout regions 94 and 96 adapted to receive arms 40*a* and 40*b*.

With this construction, handle 80 can be removably secured to mounting plate 32 by inserting projection 38 into recess 86 defined by wall 88, and pressing. Tongues 90 and 92 include respective flanges or undercuts 100 and 102 which capture respective legs 40*b* and 40*a* of pin 40 therein to releaseably hold handle 80 on rotatable lug 34. It is noted that rear surface 84 of handle 80 may include additional recessed portions 110 and 112 on the outer periphery thereof to further capture the respective ends of pin 40 and to further stabilize the attachment of handle 80 on mounting plate 32.

In view of the aforedescribed coupling the rotation of handle 80 causes like rotation of lug 34 and movement of linkage rod 39. Stopper 60, coupled to rod 39, can thus be controlled by the rotation of handle 80. It is noted that a set screw or projection 120 may be provided on mounting plate 32 to limit the amount of rotation of handle 80 thereby preventing possible damage to linkage rod 39 and its associated linkage components. Set screw 120 selectively contacts walls 111 and 113 formed on rear surface 84 of handle 80 as handle 80 is rotated.

Figure 2:
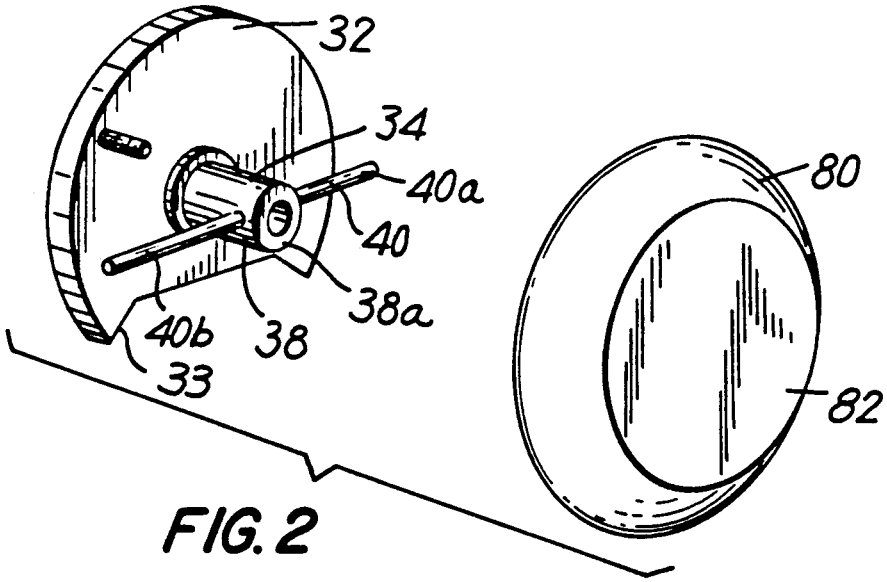
FIG. 2 is an exploded perspective view of a handle and overflow bracket as depicted in FIG. I constructed in accordance with the present invention.
Figure 4:
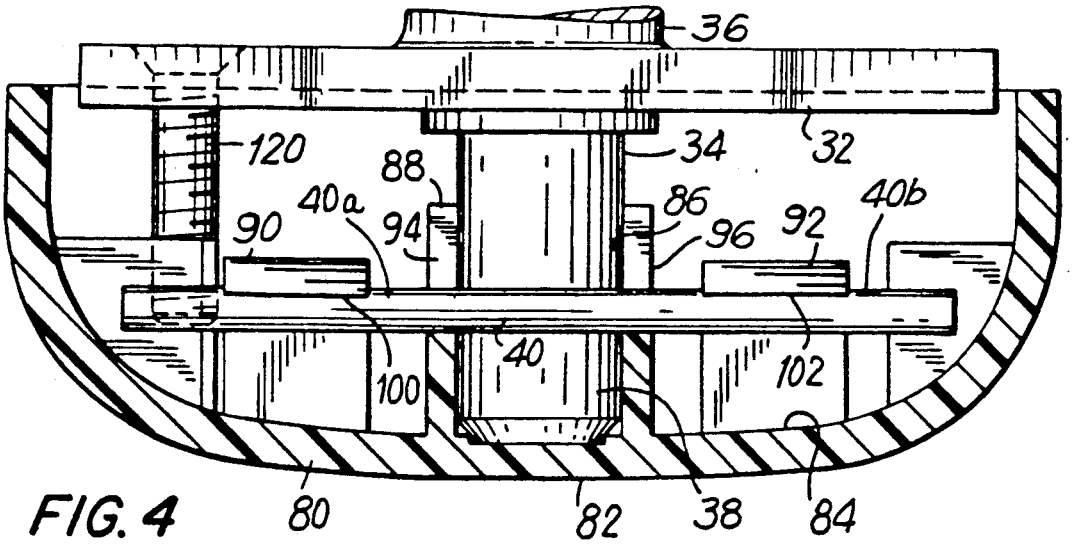
FIG. 4 is an enlarged sectional view taken along line 4—4 of FIG. 3.
Figure 5:
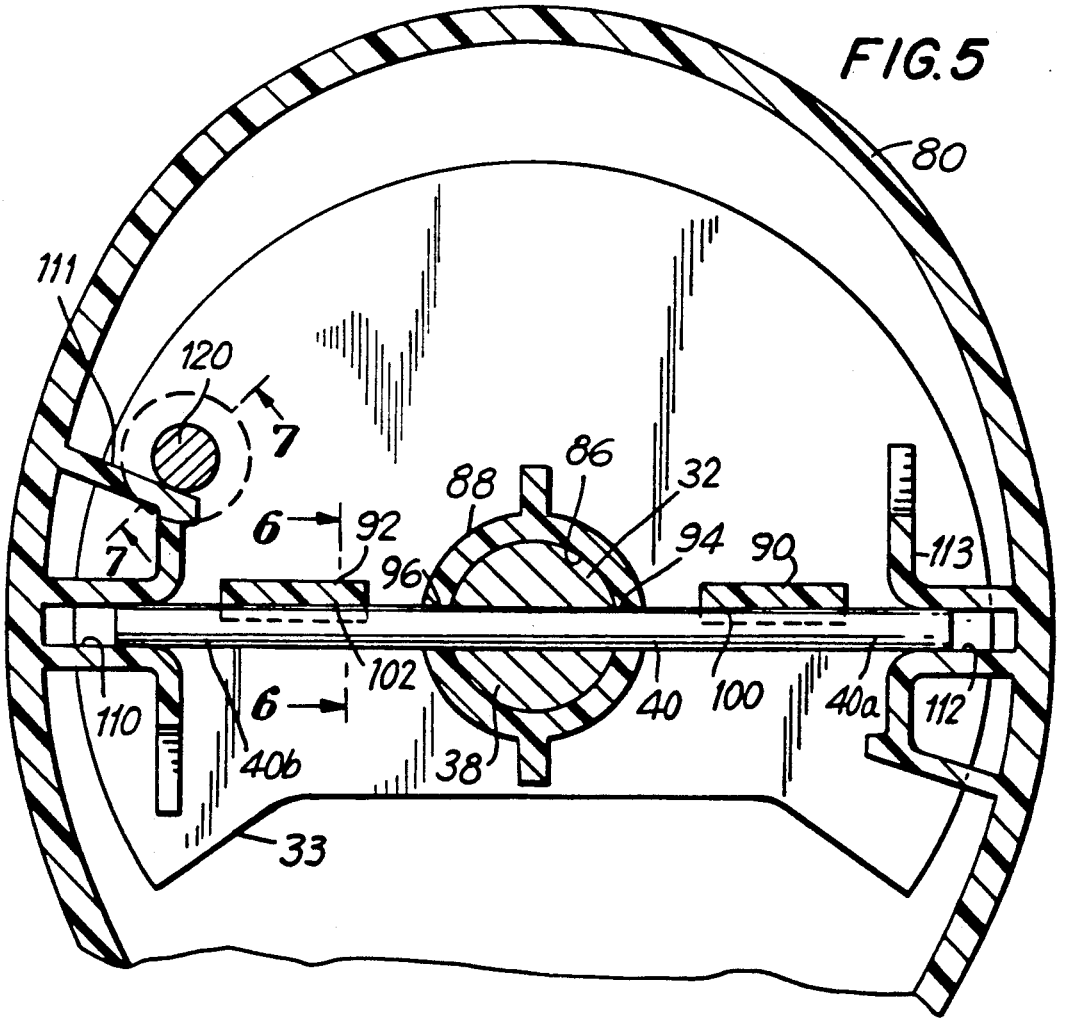
FIG. 5 is an enlarged partial sectional view taken along line 5—5 of FIG. 4.

Mounting plate 32 also includes a cutback region 33, as best depicted in FIG. 2, which exposes a portion of opening 70 to the interior of tub 50. As depicted in FIG. 3, when handle 80 is secured to lug 34, it is spaced somewhat from front surface 54*a* of tub wall 54 by a gap B thereby permitting water at the appropriate height in the tub to flow behind handle 80 through opening 70 and hence through pipe 26 into the main drain. Thus, the present construction provides both an overflow drain assembly and a control mechanism for the main drain stopper.

The present invention provides a bathtub overflow control device wherein the handle can be molded from a plastic material, have a desired ornamental appearance and be readily insertable on and removable from the control mechanism. Thus, the handle itself may be installed after complete tub and associated plumbing installation insuring that the handle will not be damaged by installers during installation of the tub and plumbing components. The handle readily snaps onto the control mechanism and can be readily removed to change covers, when necessary or desirable.

It will then be seen that the objects set forth above among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features the invention herein described and all statements of the scope of the invention which, as a matter of language, might be said fall therebetween.

What is claimed is:

1. A control mechanism for use with a tub having a drain opening and an overflow opening, said drain opening having a stopper moveable therein between an open position and a closed position, comprising pipe means for coupling said bathtub drain opening to said overflow opening, a T-shaped bracket rotatably supported in said overflow opening defined by a projection extending outwardly from said opening and having first and second opposing legs extending radially from said projection, a handle releasably supported on said T-shaped bracket for rotating said bracket, said handle having a front decorative surface and an opposing rear surface, said rear surface including a recess therein defined by a raised wall adapted to receive a portion of said projection and rearwardly extending first and second tongues on opposite sides, respectively, of said raised wall, respectively in alignment with said first and second opposing legs, each said tongue having a flange for releasably capturing said respective first and second opposing legs to hold said projection in said recess, and linkage means for linking said T-shaped bracket to said stopper.

2. The control mechanism as claimed in claim 1, further comprising a mounting plate supported on said tub at said overflow opening, said T-shaped bracket being rotatably supported by said mounting plate.

3. The control mechanism as claimed in claim 2, wherein said mounting plate includes stopping means for limiting the amount of rotation of said handle.

4. The control mechanism as claimed in claim 1, wherein said handle is molded from a plastic material.

5. The control mechanism as claimed in claim 1, wherein said first and second tongues each include an undercut at said flange for releasably holding said handle on said T-shaped bracket.

6. The control mechanism as claimed in claim 1, wherein said handle includes first and second slots on the rear surface thereof for capturing the ends of said first and second opposing legs.

7. A handle assembly for use in an overflow opening in a tub having a drain opening and stopper means for selectively opening and closing said drain opening, comprising a T-shaped bracket rotatably supported by said overflow opening defined by a projection extending outwardly from said opening and first and second opposing legs extending radially from said projection, a handle releasably supported on said T-shaped bracket, said handle having a front decorative surface and an opposing rear surface, said rear surface including at least one recess for receiving a portion of said T-shaped bracket and rearwardly extending first and second tongues respectively in alignment with said first and second opposing legs, each said tongue having an undercut for releasably capturing said respective first and second opposing legs to hold said handle on said bracket.

8. The handle assembly as claimed in claim 7, wherein said handle is molded from a plastic material.

9. The handle assembly as claimed in claim 7, wherein said first and second tongues each include a flange at said undercuts for releasably holding said handle on said T-shaped bracket.

10. The assembly as claimed in claim 7, wherein said handle includes first and second slots on the rear surface thereof for capturing the ends of said first and second opposing legs.

11. A control knob for use on a T-shaped bracket supported on the sidewall of a tub at the overflow opening thereof, said T-shaped bracket being defined by a projection with opposing legs extending outwardly from said projection, said knob comprising a handle molded from a plastic material having a front decorative surface and a rear surface, said rear surface including at least one recessed portion for receiving a portion of said T-shaped bracket and at least one tongue spaced from said recessed portion for connecting a portion of one of said opposing legs of said T-shaped bracket for releasably holding said handle on said T-shaped bracket.

12. The control knob as claimed in claim 11, further comprising a second tongue on the opposite side of said recessed portion for releasably holding said handle on said T-shaped bracket.

13. The control knob as claimed in claim 11, wherein said T-shaped bracket includes first and second opposing legs, said handle including first and second slots on the rear surface thereof for capturing a portion of said first and second opposing legs.

* * * * *